US012342881B1

(12) United States Patent
White

(10) Patent No.: US 12,342,881 B1
(45) Date of Patent: Jul. 1, 2025

(54) DISPOSABLE WRIST SECURING DEVICE WITH ESCAPE FEATURE SYSTEM AND METHOD

(71) Applicant: Tracy A. White, Cocoa, FL (US)

(72) Inventor: Tracy A. White, Cocoa, FL (US)

( * ) Notice: Subject to any disclaimer, the term of this patent is extended or adjusted under 35 U.S.C. 154(b) by 1000 days.

(21) Appl. No.: 17/396,218

(22) Filed: Aug. 6, 2021

Related U.S. Application Data

(63) Continuation-in-part of application No. 16/596,107, filed on Oct. 8, 2019, now abandoned.

(60) Provisional application No. 62/742,548, filed on Oct. 8, 2018.

(51) Int. Cl.
*A61F 5/37* (2006.01)
*A41D 20/00* (2006.01)

(52) U.S. Cl.
CPC ..... *A41D 20/00* (2013.01)

(58) Field of Classification Search
CPC .. A61F 5/3723; A61F 5/05858; A61F 5/3776; A61G 13/1235; Y10S 128/15; A41D 20/00
See application file for complete search history.

(56) References Cited

U.S. PATENT DOCUMENTS 2,377,940 A 6/1945 Hughes
3,775,782 A 12/1973 Rice et al.
3,829,914 A 8/1974 Treat
4,046,143 A * 9/1977 Bell ..... A61F 5/3715 128/882
4,239,228 A * 12/1980 Norman ..... A63B 69/0059 273/DIG. 30
4,369,982 A 1/1983 Hein et al.
4,414,969 A 11/1983 Heyman
4,473,912 A 10/1984 Scheidel et al.
4,506,664 A 3/1985 Brault
4,534,075 A 8/1985 Schnitzler
5,076,288 A * 12/1991 Millard ..... A61F 5/3776 128/869
5,718,672 A * 2/1998 Woodman ..... A61F 5/0193 602/5

(Continued)

FOREIGN PATENT DOCUMENTS

GB 2546103 A * 7/2017 ..... A61F 5/37

*Primary Examiner* — Alireza Nia
*Assistant Examiner* — Michael Milo
(74) *Attorney, Agent, or Firm* — Steinberger IP Law; Brian S. Steinberger; Hilary F. Steinberger

(57) ABSTRACT

Wrist-securing devices, apparatus, systems and methods. The wrist-securing device has two coextensive straps joined together along a midportion so resulting four end portions pivot about the midportion. The joined midportion defines two opposing ends, a first end and a second end, each end having moveable upper and lower straps. The upper and lower straps wrap about upper and lower surfaces, of the wrists. Each upper and lower strap has fasteners to removably connect and secure the straps wrapped about the wrist. Each end of the wrist-securing device may secure each wrist of an unresponsive patient receiving emergency services, and not harm the patient or occlude their circulation. An escape feature with fixed loop attached to the lower strap end allows for responsive patients to release the device The loop can be a target for a patient transporter to quickly and easily release the device from the patient.

4 Claims, 5 Drawing Sheets

(56) References Cited

U.S. PATENT DOCUMENTS

| | | | | |
|---|---|---|---|---|
| 6,846,254 | B2 * | 1/2005 | Baxter | A63B 69/0059 473/450 |
| 7,854,231 | B1 * | 12/2010 | Mostad | E05B 75/00 128/869 |
| 8,214,951 | B1 * | 7/2012 | Batta | A61G 13/1225 128/869 |
| 9,522,303 | B2 * | 12/2016 | Kim | A63B 35/02 |
| 2011/0125242 | A1 * | 5/2011 | Zahler | A61F 5/3715 607/149 |
| 2013/0239300 | A1 * | 9/2013 | Denning | A61F 13/72 2/400 |
| 2015/0230754 | A1 * | 8/2015 | Willis | A61B 5/6802 600/300 |

* cited by examiner

DISPOSABLE WRIST SECURING DEVICE WITH ESCAPE FEATURE SYSTEM AND METHOD

CROSS-REFERENCE TO RELATED APPLICATION

This application is a Continuation-In-Part of U.S. patent application Ser. No. 16/596,107 filed Oct. 8, 2019, now abandoned, which is claims the benefit of priority of U.S. provisional application No. 62/742,548, filed 8 Oct. 2018, the contents of which are herein incorporated by reference.

FIELD OF INVENTION

The application is directed to wrist securing devices, apparatus, systems and methods, and more specifically to wrist securing devices, apparatus, systems and methods with an escape feature to allow a transported patient to be able to release themselves from the wrist securing devices.

BACKGROUND OF THE INVENTION

The present invention relates to emergency medical service devices and, more particularly, to a disposable, wrist-securing device for use in the emergency medical field.

Emergency medical services (EMS), also known as ambulance services or paramedic services, provide an urgent medical response, providing out-of-hospital treatment and transport to hospitals and other institutional care facilities. Being "first responders", EMS personnel are on the front lines of medical emergencies that include treatments of acute illnesses and injuries, as well as treating those suffering from severe mental health and/or drug-related issues.

As a result, many EMS patients can be unresponsive. The upper extremities of such patients are currently not secured while the patient is in a supine position during EMS care, creating an unsafe situation for both patient and care providers. In short, currently there is no known medically safe device to effectively address and remedy this challenge.

As can be seen, there is a need for a disposable, wrist-securing device for use in the emergency medical field. The device embodied by the present invention (colloquially known as 'Kwik-Cuff') is adapted to securely hold the upper extremities of an unresponsive, supine patient in a safe position without inflicting harm or restraining them against their will, while providing a measure of safety to patient and EMS personnel during movement of the patient. The present invention secures the wrists of an unresponsive patient across the lower abdomen without injury to the patient, unlike current restraints. Moreover, the present invention does not occlude distal circulation. Kwik Cuffs simple design makes it easy to store prior to use, employ during use, and is disposable after a single use, preventing subsequent bodily fluid contamination.

Various patented devices have also been proposed over the years for restraining a person's appendages. See for example, U.S. Pat. No. 5,076,288 to Millard et al.; U.S. Pat. No. 8,214,951 to Batta; and U.S. Pat. No. 9,522,303 to Kim. These devices will generally lock a user's arms in place, or legs in place. While these devices may be helpful to restrain a patient that could harm themselves, there can be additional problems with using these devices to transport a patient on a stretcher.

These devices would not allow the patient to be able to release themselves.

These devices would generally be used to restrict the patient from being able to release their appendages without the assistance of another person, such as the person transporting the patient.

However, there are circumstances that a patient will need to be able to release themselves. For example, if a patient was initially unconscious and being transported, there would be a need to keep the hands and arms restrained to prevent injury to the patient's arms and hands falling out of the stretcher.

When the initially unconscious patient regains consciousness, they may want to release themselves, if they believe they are being restrained against their will. These prior art devices would not allow the patient to be able to release themselves.

Additionally, the transporter can have difficulty removing hook and loop fasteners that are sandwiched together, in that it would take time to peel off an edge. These current prior art devices do not have an immediate target for transporter to reach to release the prior art restraint devices. Without a clear target the transporter may struggle to peel off an edge to pull off the sandwiched fasteners from the patient.

Thus, the need exists for solutions to the problems with the prior art.

SUMMARY OF THE INVENTION

A primary objective of the present invention is to provide wrist securing devices, apparatus, systems and methods, with an escape feature to allow a transported patient to be able to release themselves from the wrist securing devices.

A secondary objective of the present invention is to provide wrist securing devices, apparatus, systems and methods, with an escape feature that would allow an initially unconscious patient that regains consciousness, to be able to release themselves after gaining consciousness.

A third objective of the present invention is to provide wrist securing devices, apparatus, systems and methods for transporting patients, with an escape feature that provides an easily accessible target for the transporter to be able to release the wrist securing devices from the patient.

In one aspect of the present invention, wrist-securing device includes the following: an upper strap; a lower strap generally coextensive with the upper strap; each strap having a first end portion and an opposing second end portion; a joining element joining the upper and lower straps between their respective end portions so that said end portions are movable about the joining element; a fastener pad along a top surface of the first and second end portions of the upper strap; a fastener tab extending from the first and second end portions of the lower strap; and the fastener pads and fastener tabs adapted to removably connect so as to secure their respective end portions together, wherein each fastener tab is mutually inclusive of the upper end portion, wherein each fastener tab extends beyond a peripheral boundary of the lower end portion, and wherein each fastener tab is disposed along a bottom surface of the lower end portion.

In another aspect of the present invention, a method of securing the wrists of an unresponsive patient in an emergency medical service situation includes the following: providing the above-mentioned wrist-securing device; wrapping the upper end portion and the lower end portion of the first end portions about opposing surfaces a first wrist of said patient; wrapping the upper end portion and the lower end portion of the second end portions about opposing surfaces a second wrist of said patient; and resting said wrists across a lower abdomen of said patient.

Further objects and advantages of this invention will be apparent from the following detailed description of the presently preferred embodiments which are illustrated schematically in the accompanying drawings.

These and other features, aspects and advantages of the present invention will become better understood with reference to the following drawings, description and claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

Second Embodiment

Figure 7:
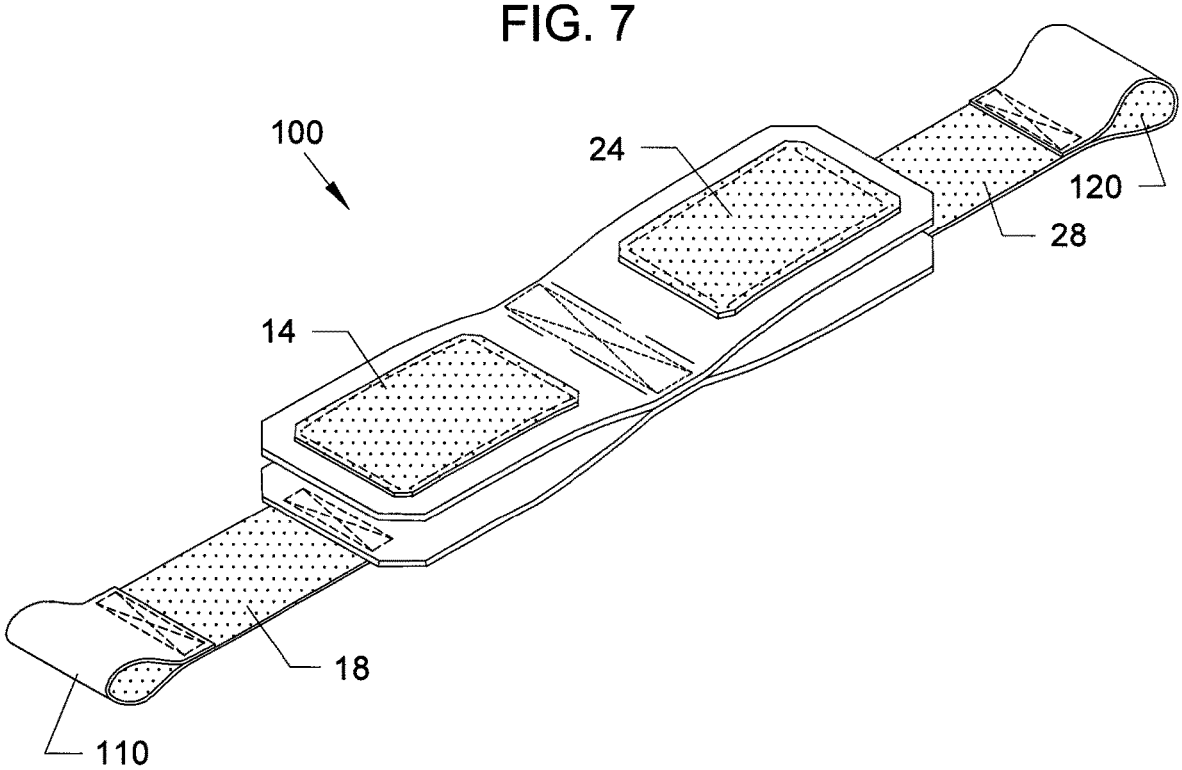

FIG. 7 is a top perspective view of a second embodiment of the present invention with an escape feature.

Figure 8:
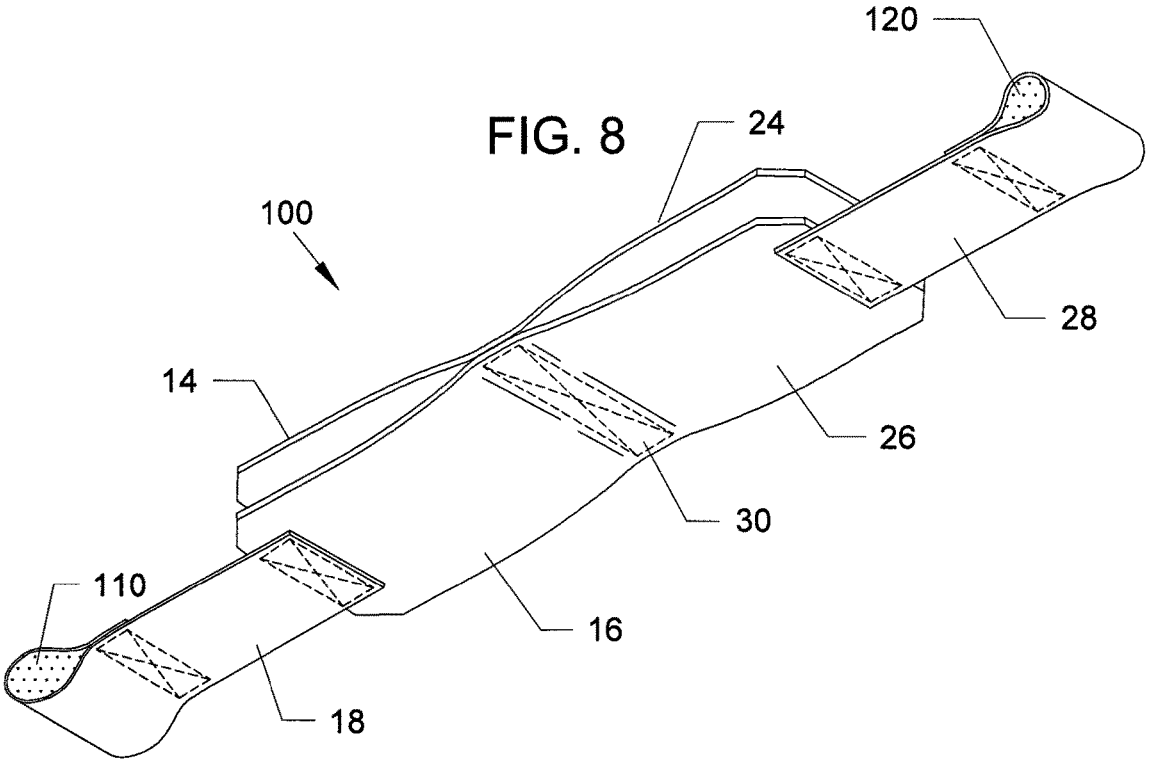

FIG. 8 is a bottom view of the second embodiment of FIG. 7.

Figure 9:
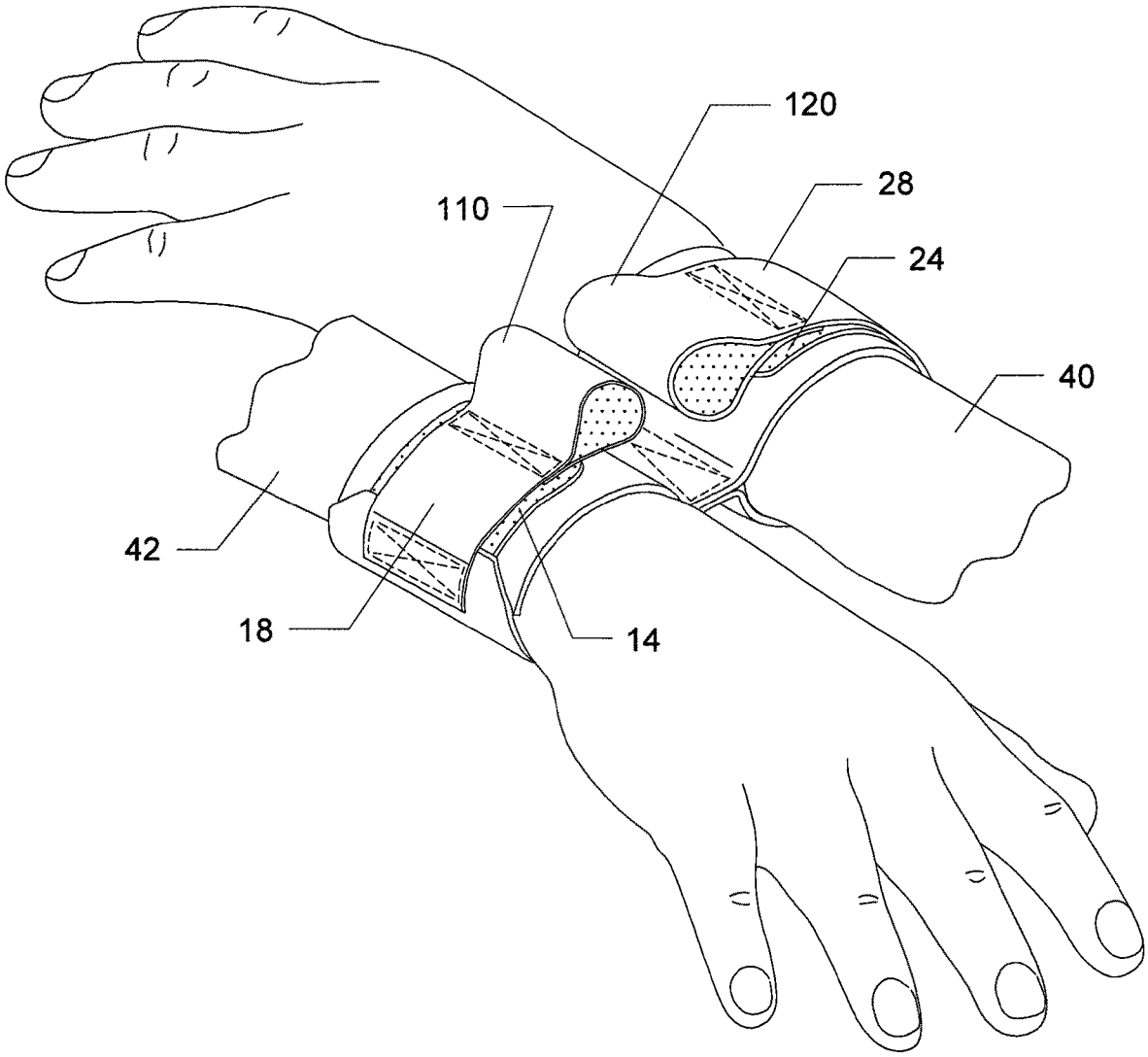

FIG. 9 is another top perspective view of the second embodiment of FIGS. 7-8 shown in use.

Figure 10:
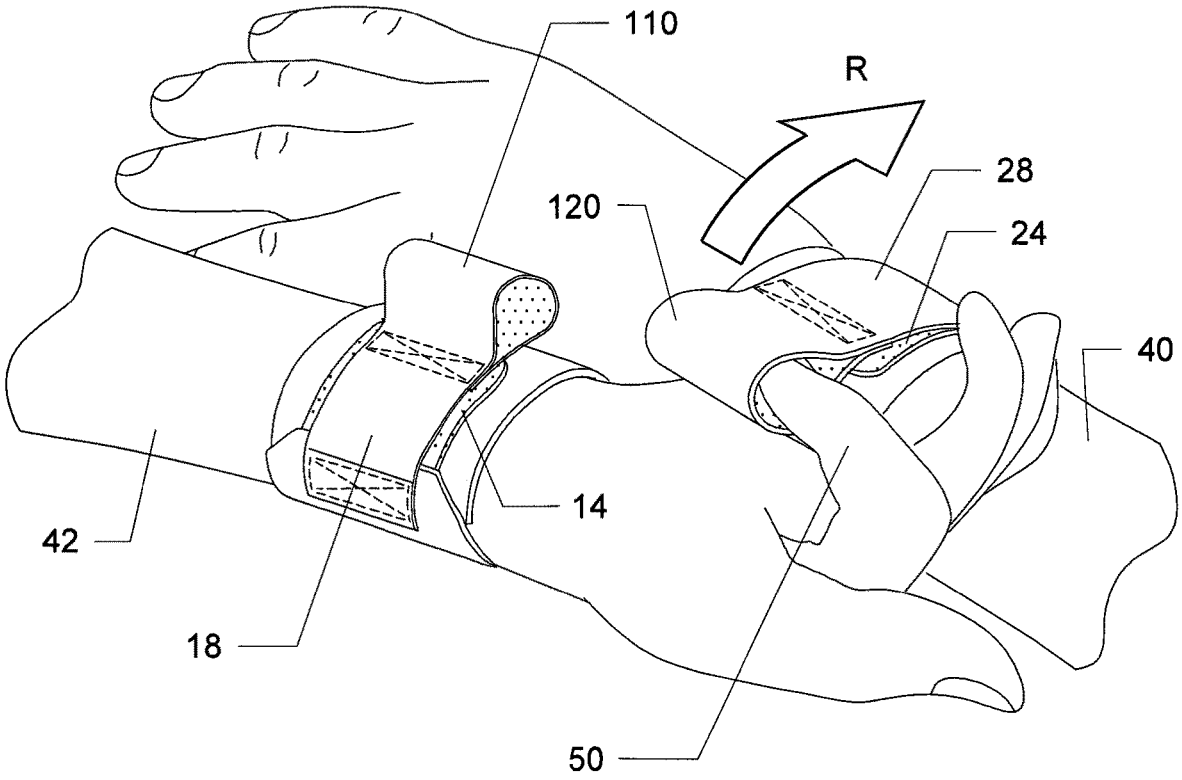

FIG. 10 is a top perspective view of the second embodiment of FIG. 9 with the escape feature being activated.

DETAILED DESCRIPTION OF THE INVENTION

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Securing device
12 first upper strap
14 upper fastener pad
16 first lower strap
18 lower fastener tab
22 second upper strap
24 upper fastener pad
26 second lower strap
28 lower fastener tab
30 joining element
40 second wrist
50 index finger
42 first wrist
100 second securing device
110 First Fixed Loop
120 Second fixed loop The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a wrist-securing device formed from two coextensive straps joined together along a midportion so that the resulting four end portions may pivot about the midportion. The joined midportion defines two opposing ends, a first end and a second end, having upper and lower straps movable relative to each other. The upper and lower straps can wrap about the upper and lower surfaces, respectively, of the wrist of human wearer. Each upper and lower strap provides upper and lower fasteners, respectively, that are adapted to removably connect so as to secure the upper and lower straps wrapped about the wrist. Thus, each end of the wrist-securing device may secure each of the wrists of an unresponsive patient receiving emergency medical services in such a manner as to not harm the patient or occlude their distal circulation.

Referring to FIGS. 1 through 6, the present invention may include a wrist-securing device 10 adapted for the emergency medical services field, as well as having utility in other fields. The wrist-securing device 10 may include generally coextensive upper and lower straps that are joined at a midportion by a joining element 30. The joining element 30 may be high-strength threading, binding or other joining fasteners that rigidly connect one object to another object. Here these objects are the upper and lower straps.

In certain embodiments, the joining element 30 may be cotton/polyester sewing thread. The upper and lower straps may be soft, breathable fabric having sufficient strength and tear-resistance so as to be exposed to the stress and strain as contemplated by the use disclosed herein without failing.

Figure 1:
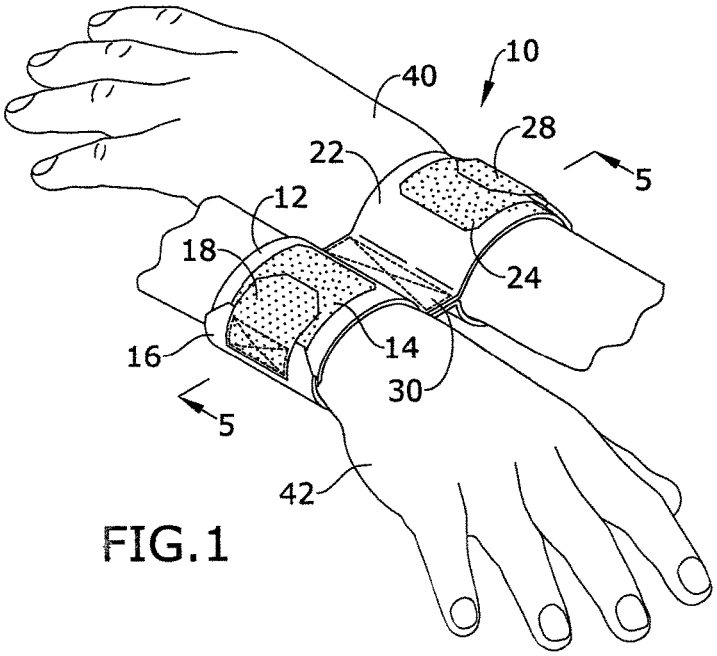
FIG. 1 is a perspective view of an exemplary embodiment of the present invention, shown in use.
Figure 2:
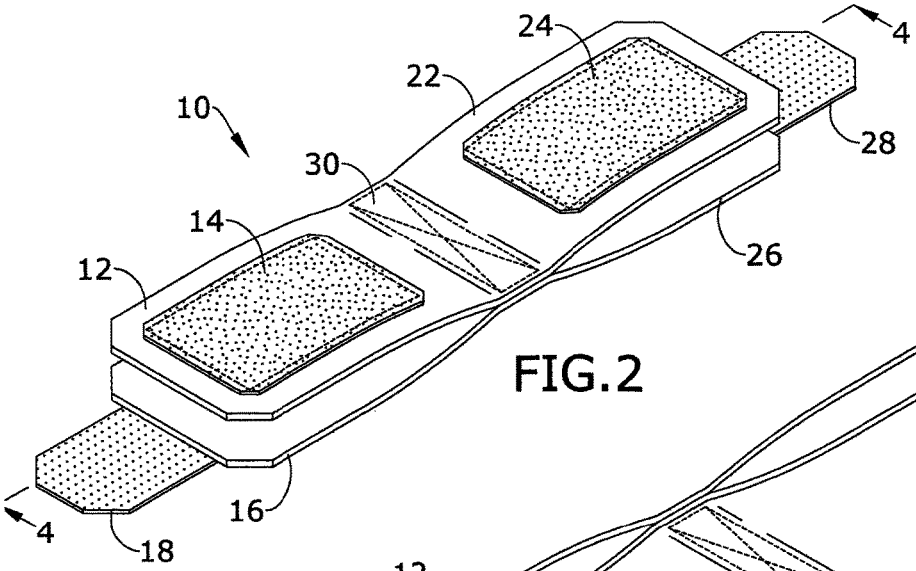
FIG. 2 is a top perspective view of an exemplary embodiment of the present invention.
Figure 3:
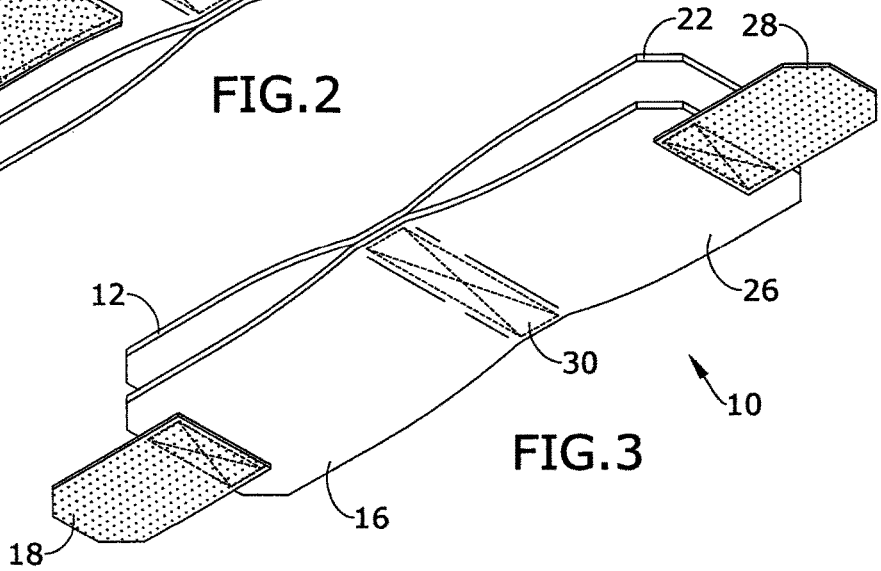
FIG. 3 is a bottom perspective view of an exemplary embodiment of the present invention.
Figure 4:
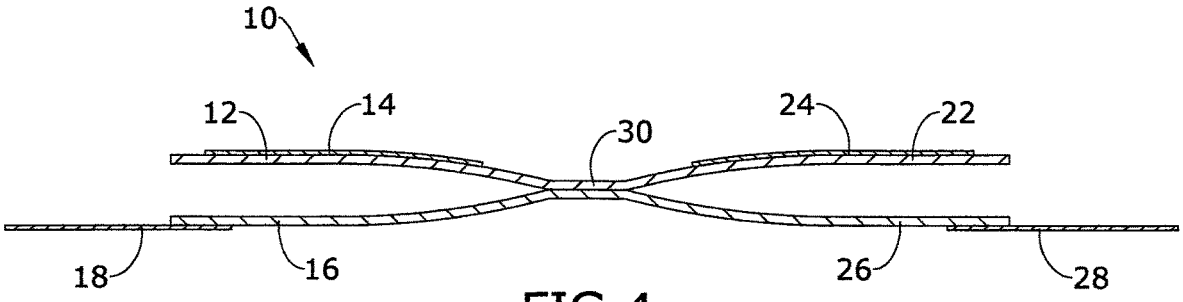
FIG. 4 is a section view of an exemplary embodiment of the present invention, taken along line 4-4 of FIG. 2.

As a result of the bisecting joining element 30 the upper and lower straps can be defined by a first upper strap 12, a second upper strap 22, a first lower strap 16 and a second lower strap 26. In an open condition, as illustrated in FIGS. 2 through 4, the wrist-securing device 10 takes an open-book configuration wherein the lower straps 16 and 26 act as the book cover, if you will, and the upper straps 12 and 22, the book pages. The outside of the 'book cover' provides a lower fastener tab 18 and 28 for the first and second lower straps 16 and 26, respectively. The lower fastener tab 18 extends beyond a distal end of each respective lower strap 16 or 26. Each 'readable book page' provides an upper fastener pad 14 and 24 that is mutually inclusive of each first and second upper strap 12 and 22, respectively.

In other words, the first and second upper straps 12 and 22 each provide one upper fastener pad 14/24 along an upward-facing or top surface, wherein each upper fastener pad 14/24 is mutually inclusive of their respective upper strap 12 or 22. While, the lower straps 16 and 26 provide lower fastener tabs 18 and 28, respectively along a bottom or downward-facing surface, wherein the lower fastener tabs 18/28 extend beyond a distal (relative to the midportion joining element 30) boundary of their respective lower straps 16 or 26.

It should be understood by those skilled in the art that the use of directional terms such as upper, lower, upward, downward, top, bottom, and the like are used in relation to the illustrative embodiments as they are depicted in the figures, specifically FIGS. 2 through 4. The upward direction (or upper, top) being toward the top of the corresponding figures and a downward (or lower, bottom) direction being toward the bottom of the corresponding figures.

The upper fastener pads 14/24 and lower fastener tabs 18/28 may be hook and loop fasteners or other mating fasteners that removably connect to each other.

Figure 5:
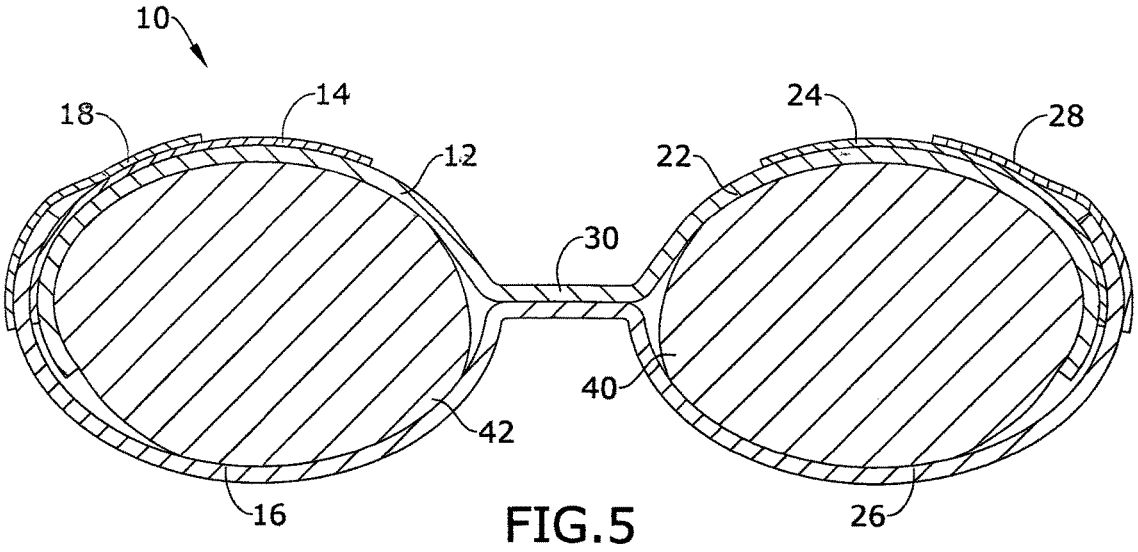
FIG. 5 is a section view of an exemplary embodiment of the present invention, taken along line 5-5 of FIG. 1.

As a result of the joining element 30 seated in the middle of the upper and lower straps, the first upper and lower straps 12 and 16 can separately wrap about the front and/or rears sides, respectively, of a first wrist 42 of a human wearer so as to overlap on the other side of said first wrist 42, whereat the associated first fastener tab 18 can overlap and operatively associate with the first fastener pad 14, as illustrated in FIG. 5. Likewise, the second upper and lower straps 22 and 26 can similarly circumscribe the second wrist 40 of the human wearer. Thus, two secured cuffs can be formed from the present invention to hold the supine patient's arm across their lower abdomen with the use of the fastener tabs and pads.

Figure 6:
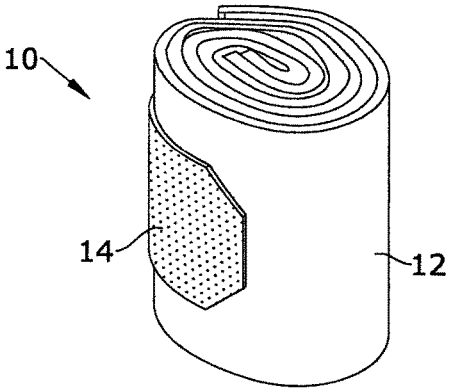
FIG. 6 is a perspective view of an exemplary embodiment of the present invention, shown in a stored condition.

A method of using the present invention may include the following. The wrist-securing device 10 disclosed above may be provide. During emergency medical care of an unresponsive or uncooperative patient, EMS care providers would secure each wrist of that patient in one of the two cuffs provided by the present invention. In this cuffed condition, the arms of the patient may be rested across their own lower abdomen. Subsequent to its removal, the wrist-securing device 10 may be disposed of in a proper medical waste container. An amputee patient would also see benefit as the open cuff not around the patient's wrist could be attached to a backboard strap to secure the remaining extremity from dangling over side of back board. Prior to use, the wrist-securing device 10 may be rolled into a storage condition, as illustrated in FIG. 6, wherein one of the fastener tabs can removably engage one of the fastener pads.

Second Embodiment

FIG. 7 is a top perspective view of a second embodiment 100 of the present invention with an escape feature. FIG. 8 is a bottom view of the second embodiment 100 of FIG. 7. FIG. 9 is another top perspective view of the second embodiment of FIGS. 7-8 shown in use. FIG. 10 is a top perspective view of the second embodiment of FIG. 9 with the escape feature being activated.

Referring to FIGS. 7-10, the second embodiment includes an escape feature of fixed loops 110, 120 that can be used by either patients and/or those transporting the patients.

The second embodiment 100 includes the same structure as that shown in the previous embodiment shown in FIGS. 1-6, with the addition of a first fixed loop 110 and second fixed loop 120 that can each be sewn to an outer edge of lower fastener tabs 18, 28. The fixed loops 110, 120 can be formed from the same material used for the tabs 18, 28 and pads 14, 24.

The tabs 18, 28 can be initially made long and have outer ends that are bent back and sewn into place forming the fixed loops 110, 120.

The fixed loops 110, 120 can be sized to allow for a finger of a patient such as but not limited to a forefinger, index finger and the like to be used.

The second embodiment 100 allows a patient being transported with the wrist securing device to be able to release themselves from the wrist securing devices.

For example, an initially unconscious patient can have their wrists secured by the wrist securing device during transport on a stretcher and the like. The initially unconscious patient that regains consciousness, who does not wish to remained restrained is able to release themselves after gaining consciousness.

Referring to FIGS. 7-10, a finger 50, such as but not limited to the index finger of a patient can be inserted into a fixed loop 120, and moved in the direction of arrow R, to remove a lower fastener tab 28 to be pulled from an upper fastener pad 24.

The patient can use either a finger, such as an index finger on either or both their hands to remove fastener tabs 18, 28 from fastener pads 14, 24.

Additionally, the escape feature loops 110, 120 provides an easily accessible target for the transporter of the patient to be able to release the wrist securing devices from the patient. Without the fixed loops 110, 120, the transporter would not have an easy target to allow for removing the fastener tabs 18, 28 from the fastener pads 14, 24.

While the above embodiment has the fixed loops 110, 120 on the fastener tabs, the fixed loops can be on the fastener pads.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

It should be understood, of course, that the foregoing relates to exemplary embodiments of the invention and that modifications may be made without departing from the spirit and scope of the invention as set forth in the following claims.

What is claimed is:

1. A wrist-securing device for transporting a patient with an escape feature, comprising:

an upper strap;

a lower strap coextensive with the upper strap;

each strap having a first end portion and an opposing second end portion;

a joining threaded element joining the upper and lower straps between their respective end portions so that said end portions are movable about the joining element;

a first fastener pad of hook and loop fasteners, along a top surface of the first end portion of the upper strap, a second fastener pad of hook and loop fasteners, along a top surface of the second end portion of the upper strap, wherein each fastener pad is inward of each peripheral boundary of said end portion;

a first fastener tab of hook and loop fasteners, connected to the first end portion of the lower strap;

a second fastener tab of hook and loop fasteners, connected to the second end portion of the lower strap, each fastener tab extends linearly between a connected portion and an overhang portion, wherein the overhang portion extends beyond a peripheral boundary of each end portion of the lower strap, wherein each fastener tab is disposed along a bottom surface of the lower end portion;

the first and the second fastener pads and the first and the second fastener tabs adapted to removably connect so as to secure their respective end portions together, an entirety of each fastener tab extends linearly and is planar and directly attaches to each fastener pad; wherein an entirety of each fastener pad is linear and planar on the upper strap; and a first fixed sewn loop attached to the first at least one fastener tab, a second fixed sewn loop attached to the second fastener tab, wherein each of the first fixed sewn loop and the second fixed sewn loop allows for easy and quick release of the wrist securing device, wherein the wrist-securing device is configured for a central axis of the first fixed sewn loop and a central axis of a second fixed sewn loop are parallel and adjacent to each other so that one of the first fixed sewn loop and the second fixed sewn loop being rotatably pulled in a horizontal direction away from a resting first wrist and second wrist adapted for resting on a patient's abdomen, allows for easy and quick release of the wrist securing device, when transporting the patient.

2. The wrist securing device with escape feature of claim 1, wherein the first fixed loop and the second fixed loop are each is sized to adapted for a single finger to pass therethrough.

3. A method of securing wrists of an unresponsive transporting patient in an emergency medical service situation, and allowing for quick release, comprising the steps of:

providing an upper strap with a first end portion and a second end portion, each end portion having a fastener pad of hook and loop fasteners; wherein an entirety of each fastener pad is linear and planar on the upper strap;

providing a lower strap with a first end portion and a second end portion, each end portion having a fastener tab of hook and loop fasteners; wherein an entirety of each fastener tab extends linearly and is planar;

providing a first fixed sewn loop attached to the first at least one fastener tab;

providing a second fixed sewn loop attached to the second fastener tab;

wrapping the first end portion of the upper strap and the first end portion of the lower strap about opposing surfaces of a first wrist of said patient so that the first end portion of the lower strap wraps over the first end portion of said upper strap;

wrapping the second end portion of the upper strap and the second end portion of the lower strap about opposing surfaces of a second wrist of said patient so that the second end portion of the lower strap wraps over the second end portion of said upper strap;

securing the hook and loop fasteners of each fastener tab to the hook and loop fasteners of each fastener pad;

resting said first wrist and said second wrist across a lower abdomen of said patient so that a first central axis of the first fixed sewn loop and a second central axis of the second fixed sewn loop are parallel and adjacent to each other; and releasing at least one fastener tab secured to at least one fastener pad by pulling at least one of the first fixed sewn loop, and the second fixed sewn loop upward and in a horizontal direction away from the resting first wrist and the second wrist, which allows for easy and quick release of a wrist securing device, when transporting the patient, wherein the releasing step includes the step of:

releasing the at least one fastener tab by a finger of the patient or a transporter inserted into one of the first fixed sewn loop or the second fixed sewn loop.

4. A wrist-securing device with an escape feature for transporting a patient, comprising:

an upper strap;

a lower strap coextensive with the upper strap;

each strap having a first end portion and an opposing second end portion;

a threaded joining element joining the upper and lower straps between their respective end portions so that said end portions are movable about the joining element;

a fastener pad of hook and loop fasteners, along a top surface of each end portion respectively of the upper strap, wherein the fastener pad is inward of each peripheral boundary of said end portion;

a fastener tab of hook and loop fasteners, connected to each end portion, respectively, of the lower strap, each fastener tab extends linearly between a connected portion and an overhang portion, wherein the overhang portion extends beyond a peripheral boundary of said end portion of the lower strap;

the fastener pads and fastener tabs adapted to removably connect so as to secure their respective end portions together;

a first fixed sewn loop attached to the first fastener tab; and a second fixed sewn loop attached to the second fastener tab, wherein an entirety of each fastener tab extends linearly and is planar and directly attaches to each fastener pad; wherein an entirety of each fastener pad is linear and planar on the upper strap; wherein the wrist-securing device is configured for a central axis of the first fixed sewn loop and a central axis of a second fixed sewn loop are parallel and adjacent to each other, so that one of the first fixed sewn loop and the second fixed sewn loop being rotatably pulled in a horizontal direction away from a resting first wrist and second wrist adapted for resting on a patient's abdomen, allows for easy and quick release of the wrist securing device, when transporting the patient.

* * * * *